United States Patent [19]

Ainsworth

[11] 3,965,504

[45] June 29, 1976

[54] BEDDING ASSEMBLY

[76] Inventor: Phillis Ainsworth, 18500 Mayall St., Apt. D, Northridge, Calif. 91324

[22] Filed: May 1, 1975

[21] Appl. No.: 573,479

[52] U.S. Cl. ..... 5/334 C; 5/335

[51] Int. Cl.[2] ..... A47G 9/00

[58] Field of Search ..... 5/334 R, 334 C, 335, 5/336, 343

[56] References Cited

UNITED STATES PATENTS

| | | | |
|---|---|---|---|
| 2,567,072 | 9/1951 | Kay | 5/334 C |
| 2,832,967 | 5/1958 | Sobel | 5/343 X |
| 3,066,321 | 12/1962 | Kintner | 5/334 C |
| 3,083,378 | 4/1963 | Pursell | 5/334 C |
| 3,317,933 | 5/1967 | Meyer et al. | 5/335 |
| 3,530,487 | 9/1970 | Beer | 5/335 X |
| 3,654,059 | 4/1972 | Zisblatt | 5/335 R |
| 3,879,777 | 4/1975 | Walker | 5/334 C |

*Primary Examiner*—Paul R. Gilliam
*Assistant Examiner*—Andrew M. Calvert

[57] ABSTRACT

An improved bedding assembly, particularly adapted for transport in a camper vehicle and utilizable in a camping mode comprises a mattress, top and bottom sheets and heat insulating means such as a blanket, bedspread or the like, disposed in stacked, non-slip relation and releasably interconnected along interconnection lines adjacent opposite long sides thereof, said sheets also being interconnected at the foot end but not the head end thereof. The top sheet and blanket are wider between the interconnection lines than are the mattress and bottom sheet so that a pocket, open at the head end, is formed between the top and bottom sheets, into which pocket the camper can dispose himself for sleep. The assembly stays together neatly regardless of the presence of the camper and so need not be remade after each night's occupancy. The assembly may further include a bed pad and a bedspread interconnected through zippers disposed along the interconnection lines. The top sheet, blanket and bedspread may also be interconnected through connector means such as spaced Velcro strips or the like. The bottom sheet and pad may be similarly interconnected. The assembly is simple, compact and light in weight.

10 Claims, 1 Drawing Figure

BEDDING ASSEMBLY

BACKGROUND OF THE INVENTION

A. Field of the Invention

The present invention generally relates to bedding and more particularly to a portable bedding assembly particularly adapted for camping and the like.

B. Description of Prior Art

Conventional types of bedding are generally unsuitable for use for such purposes as camping and the like. In this regard the usual assembly of bedding material on a bed in, for example, a camper vehicle comprises a mattress, pad, bed sheets, blanket and bedspread or comforter disposed in loosely stacked relation upon each other. When a bed having the same is occupied by the camper for a length of time, such as overnight, such bedding usually becomes totally disordered so that it must be reassembled before it can be reused. This constitutes undesirable work which delays the camper and inhibits the enjoyment of the camper. Moreover, such bedding cannot easily be moved by hand to a clearing or the like for use external of the vehicle.

If a conventional portable sleeping bag or sack is employed by the camper in place of the previously described bedding, another type of difficulty arises. Thus, sleeping bags are usually expensive. Moreover, they cannot easily be cleaned and refurbished. In addition, they can be uncomfortable. Accordingly, on a long camping trip they may become unsanitary, uncomfortable and generally undesirable.

Therefore, a need has arisen for an improved bedding assembly, sufficiently inexpensive, cleanable, sanitary, transportable and convenient so as to be particularly suitable for use in camping activities and the like.

SUMMARY OF THE INVENTION

The foregoing needs have been satisfied by the improved bedding assembly of the present invention. The improved assembly is substantially as set forth in the Abstract above. Thus, the assembly includes, in stacked relation, a mattress (with or without a bed pad disposed on its upper surface), sheeting comprising a top sheet and a bottom sheet, and heat insulating means such as either a bedspread (or comforter) or blanket, or both. The components of the assembly are releasably interconnected so that they maintain their assembled relation but yet can be easily taken apart for cleaning, replacement and/or repair, as needed. Each such component is readily available and inexpensive. The top and bottom sheets are connected at the foot end but not at the head end of the assembly. The bottom sheet is matched and connected to the underlying pad and mattress, while the top sheet is wider than the bottom sheet and is dimensioned and connected to the overlying blanket and bedspread. The bedspread is connected at the sides thereof to the pad so that a sleeping pocket is formed between the two sheets. This pocket is easily maintained due to the various interconnections of the described components.

Therefore, the assembly of the present invention is easily transportable and reusable without any reassembly or adjusting of the same, so that it has the advantages of conventional bedding and also of sleeping bags without the disadvantages of either. Further advantages are set forth in the following detailed description and accompanying drawings.

DRAWING

The single FIGURE schematically depicts in perspective view a preferred embodiment of the improved bedding assembly of the invention, the components thereof being shown in stacked but separated or exploded relation for the purposes of clarity, with portions being broken away to illustrate certain features and certain other portions being shown in dotted outline.

DETAILED DESCRIPTION OF THE PREFERRED EMBODIMENT

Figure 1:
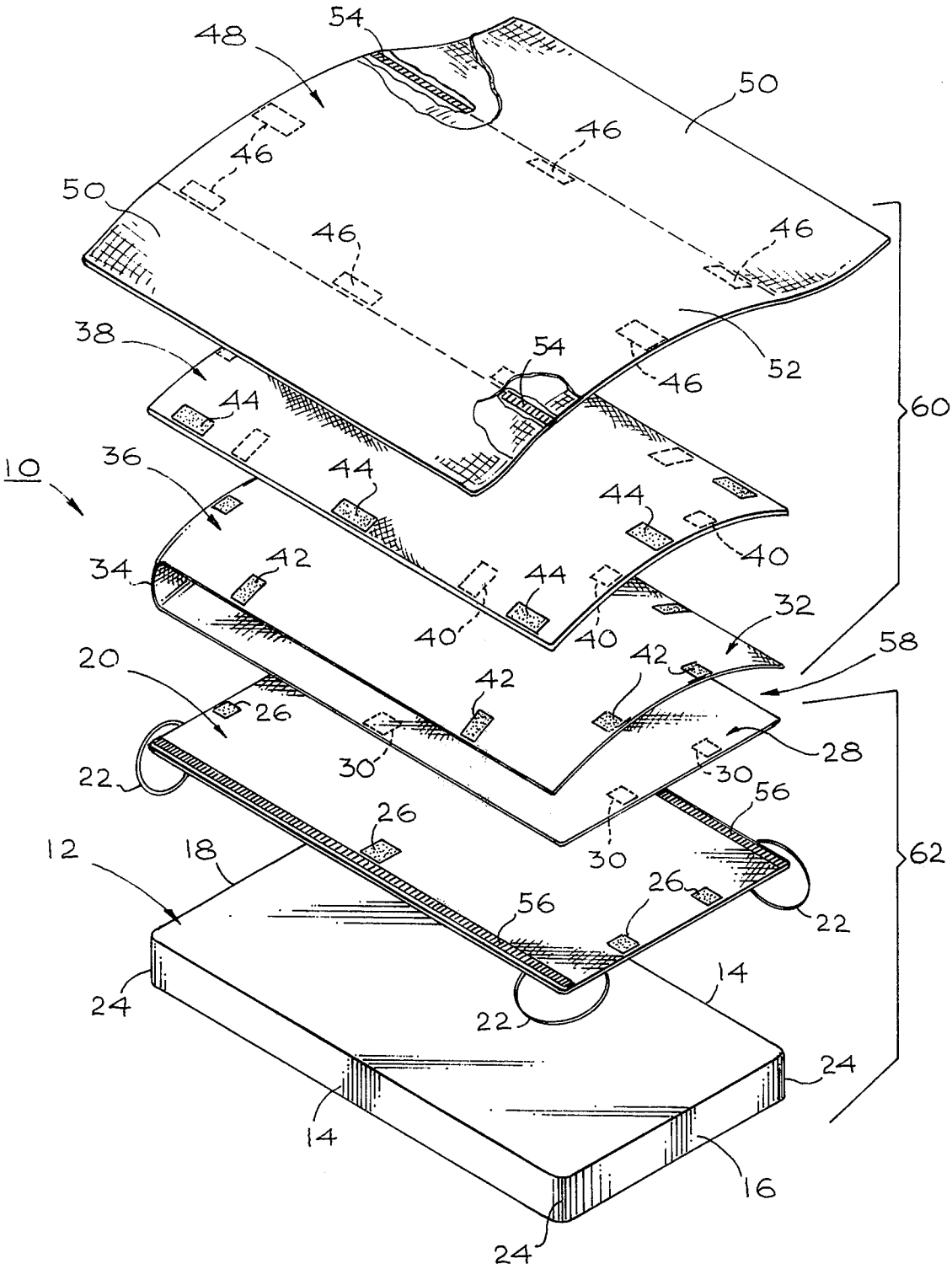

Now referring to the single FIGURE of the drawings, improved bedding assembly 10 is schematically illustrated. Assembly 10 includes a mattress 12 which can be of any suitable size, shape and construction, but preferably is rectangular. Assembly 10 conforms in general shape to mattress 10 so that assembly 10 has two long sides 14, a head end 16 and a foot end 18. Assembly 10 may further include, if desired, a generally flat bed pad 20 disposed on the upper surface of mattress 12 and releasably connected to mattress 12 by flexible straps 22 which are normally looped down around the corners 24 of mattress 12.

The upper surface of pad 20 bears a plurality of spaced connectors in the form of Velcro or other releasable adhesive strips 26 or the like disposed around the periphery thereof. A bottom rectangular bed sheet 28 is disposed on the upper surface of pad 20 and releasably connected thereto by Velcro strips 30, or the like, on the underside thereof, which strips 30 match strips 26. Sheet 28 is connected to a rectangular top sheet 32 at the foot end 34 thereof. Top sheet 33 preferably comprises the looped over portion of a single sheeting 36, the bottom portion thereof being sheet 28.

It will be noted that bottom sheet 28, bed pad 20 and mattress 12 are of the same shape and width and, preferably, the same length. However, top sheet 32 is wider than bottom sheet 28, as is heat insulating means in the form of a generally rectangular blanket 38 disposed on the upper surface of top sheet 32. Blanket 38 is releasably connected to sheet 32, as by spaced releasable adhesive strips 40, such as Velcro strips, on the underside of blanket 38 and matching similar strips 42 on the upper surface of sheet 32.

Spaced strips 44, similar to strips 42 and 40, are disposed on the upper surface of blanket 38 and match spaced strips 46 on the underside of a rectangular bedspread 48, releasably securing bedspread 48 to the upper surface of blanket 38. Bedspread 48 may be wider, if desired, and as shown in the single FIGURE, than blanket 38, so that side panels 50 thereof can hang down and overlap the side margins of assembly 10.

The width of the central portion 52 of bedspread 48 about matches the width of blanket 38 and top sheet 32, and such width is, as previously mentioned, greater than the width of bottom sheet 28, pad 20 and mattress 12. In this regard, on the underside of bedspread 48 along the inner margin of each of side panels 50 thereof is disposed releasable attaching means such as a zipper half 54 which is releasably interconnected with a matching means such as a zipper half disposed along the edge of pad 20 on the same side thereof. Preferably, zipper halves 36 extend the length of the sides of pad 20.

When the described components of assembly 10 are fully interconnected, a sleeping pocket 58 is defined between top sheet 32 and bottom sheet 28. Pocket 58 is open at the head end 16 of assembly 10 but is closed at foot end 18 of assembly 10. The side margins (not shown) of pocket 58 are sealed, due to the zipper interconnection of bedspread 48 with pad 20. The width of the top sub-assembly 60 comprising top sheet 32, blanket 38 and central portion 52 of bedspread 48 is made sufficiently greater than that of the bottom sub-assembly 62 comprising bottom sheet 28, pad 20 and mattress 12 so that an adult camper can easily but snugly fit into pocket 58 for maximum comfort.

Since the components of assembly 10 keep in perfect alignment when fully interconnected, as described, assembly 10 does not become rumpled and disarranged with use, but always presents a neat, freshly made up appearance. Moreover, it can be made light in weight and inexpensive and of conventional materials. It also can easily be transported by vehicle and by hand from place to place without coming apart or become disarranged. Moreover, it can be easily and rapidly disassembled when it is desired to clean, replace or repair any of its components and it can be just as easily reassembled for reuse.

If desired, pad 20 and/or blanket 38 could be eliminated from assembly 10. Moreover, blanket 38 could be substituted for bedspread 48. In each instance, it would be necessary to assure that suitable means for releasably interconnecting top sub-assembly 60 and bottom sub-assembly 62 would be provided which also would assure formation of the desired pocket 58. Moreover if it is desired to make blanket 38 and/or sheet 32 wider than central portion 52 of bedspread 48, suitable openings (not shown) could be provided in blanket 38 and sheet 32 to permit the aforesaid zipper interconnection between bedspread 48 and pad 20.

Various other modifications, changes, alterations and additions can be made in the bedding assembly of the invention and in the components thereof. All such modifications, changes, alterations and additions as are within the scope of the appended claims form part of the present invention.

What is claimed and desired to be secured by Letters Patent is:

1. An improved bedding assembly, comprising, in combination, a mattress, sheeting means having top and bottom portions, heat insulating means, means releasably interconnecting said top and bottom portions and heat insulating means in a stacked, non-slip relation along interconnection lines adjacent two opposite long sides thereof, said top and bottom portions of said sheeting means being connected at the foot end thereof but not the head end thereof, wherein the width of said bottom portion of said sheeting means between said interconnection lines is substantially the same width as the width of said mattress, and wherein the width of said upper portion of said sheeting means and said insulating means between said interconnection lines is substantially greater than the width of said lower portion of said sheeting means, whereby a body-receiving open sleeping pocket is formed between the top and bottom portions of said sheeting means.

2. The improved assembly of claim 1 wherein said top and bottom portions comprise single continuous sheeting of varying width lapped over itself and wherein said heat insulating means comprises a blanket.

3. The improved assembly of claim 2 wherein said assembly includes a bed pad disposed between and releasably interconnected to said mattress and said bottom portion and of about the same width as said bottom portion and mattress between said lines of interconnection.

4. The improved assembly of claim 3 wherein said assembly includes a bedspread disposed over and releasably connected to said blanket and of about the same width as said blanket between said lines of interconnection.

5. The improved assembly of claim 4 wherein said mattress, pad and bottom portion are of about the same total width, and wherein said bedspread overlaps the sides of said mattress, pad and bottom portion.

6. The improved assembly of claim 5 wherein said assembly is a generally rectangular portable camper-bedding assembly adapted to retain its shape during transit and wherein at least some of said interconnection lines comprise zippers.

7. The improved assembly of claim 6 wherein said bed pad is releasably connected to said mattress through straps looped over the corners of said mattress, wherein one half of a zipper is disposed along each of said two sides of said pad and wherein the matching half of each zipper is disposed on the underside of said bedspread at said interconnection lines and is secured to the adjacent of said pad zipper halves.

8. The improved assembly of claim 7 wherein said bottom portion is releasably secured to said bed pad, wherein said top portion is releasably secured to said blanket and said blanket is releasably secured to said bedspread, in each instance at a plurality of spaced points by connector means.

9. The improved assembly of claim 8 wherein said connector means comprise matching strips of Velcro tape.

10. The improved assembly of claim 8 wherein said blanket and top portion are sufficiently narrow and are interconnected to said bedspread in a manner such that said bedspread zippers are unobscured and are freely releasably secured to said pad zippers.

* * * * *